US008230907B2

(12) United States Patent
Thayer et al.

(10) Patent No.: US 8,230,907 B2
(45) Date of Patent: Jul. 31, 2012

(54) HEAT PIPE WITH AXIAL AND LATERAL FLEXIBILITY

(75) Inventors: John Gilbert Thayer, Lancaster, PA (US); Clark Scott Schaeffer, Ephrata, PA (US); Samuel W. Apicelli, Bryn Mawr, PA (US)

(73) Assignee: Thermal Corp., Stanton, DE (US)

( * ) Notice: Subject to any disclaimer, the term of this patent is extended or adjusted under 35 U.S.C. 154(b) by 0 days.

(21) Appl. No.: 12/689,135

(22) Filed: Jan. 18, 2010

(65) Prior Publication Data

US 2010/0170661 A1 Jul. 8, 2010

Related U.S. Application Data

(63) Continuation of application No. 11/256,708, filed on Oct. 24, 2005, now Pat. No. 7,647,961.

(60) Provisional application No. 60/621,748, filed on Oct. 25, 2004.

(51) Int. Cl.
*F28D 15/00* (2006.01)
*H05K 7/20* (2006.01)

(52) U.S. Cl. ..... 165/104.26; 361/700

(58) Field of Classification Search ..... 165/104.26; 361/700

See application file for complete search history.

(56) References Cited

U.S. PATENT DOCUMENTS 3,604,504 A * 9/1971 Kessler et al. ..... 165/46
3,844,342 A * 10/1974 Eninger et al. ..... 165/104.26
3,913,665 A * 10/1975 Franklin et al. ..... 165/104.26
4,003,427 A * 1/1977 Leinoff et al. ..... 165/104.26
4,018,269 A * 4/1977 Honda et al. ..... 165/104.26
4,019,571 A * 4/1977 Kosson et al. ..... 165/104.26
4,116,266 A * 9/1978 Sawata et al. ..... 165/104.26
4,402,358 A * 9/1983 Wolf ..... 165/276
4,463,798 A * 8/1984 Pogson et al. ..... 165/104.23
4,951,740 A * 8/1990 Peterson et al. ..... 165/276
5,413,167 A 5/1995 Hara et al.
5,771,967 A * 6/1998 Hyman ..... 165/274
5,884,693 A 3/1999 Austin et al.
5,890,371 A 4/1999 Rajasubramanian et al.
5,946,187 A 8/1999 Cipolla
6,076,595 A 6/2000 Austin et al.
6,766,817 B2 7/2004 Silva (Continued)

OTHER PUBLICATIONS

United States Patent Office Action for U.S. Appl. No. 11/256,708 dated Oct. 17, 2008 (11 pages).

(Continued)

*Primary Examiner* — Cheryl J Tyler
*Assistant Examiner* — Brandon M Rosati
(74) *Attorney, Agent, or Firm* — Michael Best & Friedrich LLP

(57) ABSTRACT

A flexible heat pipe for use with evaporator and condenser elements for removing heat from electronic components. The flexible heat pipe includes a bellows member fixed at one end to a condenser member and at an opposite end to an evaporator member. A cable artery is disposed within the bellows and is fixed at one end to the evaporator, and slidingly engages the condenser at the opposite end. The bellows acts as a flexible vapor envelope, and the cable artery acts as a flexible wick for directing condensed working fluid from the condenser back to the evaporator. The sliding connection between the cable artery and the condenser allows relative axial movement, and the inherent flexibility of the cable artery allows relative lateral movement. Thus, the condenser and evaporator can move in all directions with respect to each other, which can provide desired vibration isolation of the two components.

16 Claims, 4 Drawing Sheets

U.S. PATENT DOCUMENTS

| | | | | |
|---|---|---|---|---|
| 6,896,040 | B2 * | 5/2005 | Hul-Chun | 165/104.26 |
| 7,168,480 | B2 * | 1/2007 | Jankowski et al. | 165/104.26 |
| 7,647,961 | B2 * | 1/2010 | Thayer et al. | 165/104.26 |
| 2007/0267179 | A1 * | 11/2007 | Hou et al. | 165/104.26 |

OTHER PUBLICATIONS

United States Patent Office Notice of Allowance for U.S. Appl. No. 11/256,708 dated Sep. 4, 2009 (6 pages).

* cited by examiner

HEAT PIPE WITH AXIAL AND LATERAL FLEXIBILITY

CROSS-REFERENCE TO RELATED APPLICATION

This is a non-provisional application of prior U.S. provisional patent application Ser. No. 60/621,748, filed Oct. 25, 2004, by J. Thayer et al., titled "Heat Pipe with Axial and Lateral Flexibility," the entire contents of which application is incorporated by reference herein.

FIELD OF THE INVENTION

The present invention generally relates to heat pipes for removing heat from electrical components, and, more particularly, to a flexible heat pipe which allows axial and lateral movement between evaporator and condenser components engaged to opposite ends of the heat pipe.

BACKGROUND OF THE INVENTION

It has been suggested that a computer is a thermodynamic engine that sucks entropy out of data, turns that entropy into heat, and dumps the heat into the environment. The ability of prior art thermal management technology to get that waste heat out of semiconductor circuits and into the environment, at a reasonable cost, limits the density and clock speed of electronic systems.

A typical characteristic of heat transfer devices for electronic systems is that the atmosphere is the final heat sink of choice. Air cooling gives manufacturers access to the broadest market of applications. Another typical characteristic of heat transfer devices for electronics today is that the semiconductor chip thermally contacts a passive aluminum spreader plate, which conducts the heat from the chip to one of several types of fins; these fins convect heat to the atmosphere with natural or forced convection.

As the power to be dissipated by semiconductor devices increases with time, a problem arises: over time the thermal conductivity of the available materials becomes too low to conduct the heat from the semiconductor device to the fins with an acceptably low temperature drop. The thermal power density emerging from the semiconductor devices will be so high that even copper or silver spreader plates will not be adequate.

One technology that has proven beneficial is the heat pipe. A heat pipe includes a sealed envelope that defines an internal chamber containing a capillary wick and a working fluid capable of having both a liquid phase and a vapor phase within a desired range of operating temperatures. When one portion of the chamber is exposed to relatively high temperature it functions as an evaporator section. The working fluid is vaporized in the evaporator section causing a slight pressure increase which forces the vapor to a relatively lower temperature section of the chamber, defined as a condenser section. The vapor is condensed in the condenser section and returns through the capillary wick to the evaporator section by capillary pumping action. Because a heat pipe operates on the principle of phase changes rather than on the principles of conduction or convection, a heat pipe is theoretically capable of transferring heat at a much higher rate than conventional heat transfer systems. Consequently, heat pipes have been utilized to cool various types of high heat-producing apparatus, such as electronic equipment (see, e.g., U.S. Pat. Nos. 5,884,693, 5,890,371, and 6,076,595).

In some cases it is desirable for the heat pipe to be flexible, either to allow for thermal expansion (e.g. where the heat pipe has one or more bends to move around system components), or to provide vibration damping or insulation for the heat source. Often it is desirable to place the condenser in a remote location, either to provide access to forced cooling elements or to route the condenser to a space having a relatively low ambient temperature compared to that in which the evaporator is located. In some cases, the condenser is located near vibrating system components, and the condenser can pick up some of this vibration. With rigid heat pipes, this vibration can be transmitted back to the evaporator and thus to the component that is being cooled, such as a computer CPU.

One example of a flexible heat pipe is provided in U.S. Pat. No. 5,413,167 to Hara et al., in which one or more flexible heat pipes are used to provide heat transmission between a heat source and a heat exchanger. The Hara patent discloses a flexible heat pipe having a corrugated form to provide a desired flexibility. The wick is adhered to the interior surface of the bellows.

It would be advantageous to combine a bellows arrangement with a cable artery-type wick, rather than simply applying the wick to the interior surface of the bellows. This is because applying the wick material to the interior surface of the bellows corrugations limits the amount the bellows can be compressed. Thus, for very small size heat pipes there will be insufficient room for wick material between the corrugations while still allowing the desired compression. There are also issues of fragility of the bellows, change in stiffness (perhaps exceeding vibration transmissibility), and the extended length of travel for the condensate being wicked along the bellows surface (thus degrading wick maximum power capacity), all of which make application of wick material to the interior surface of the bellows undesirable. A cable artery-type wick, however, may not have the desired degree of axial flexibility due to the nature of its construction, and therefore when its ends are fixed to the evaporator and the condenser, it can form an undesirable rigid link between the two. Thus, there is a need for a flexible heat pipe system that combines the advantages of a bellows type heat pipe with a cable artery-type wick and also provides a desired degree of axial and lateral flexibility.

SUMMARY OF THE INVENTION

A flexible heat pipe is disclosed for conveying heat from a vibration isolated heat source to a vibrating cold plate. In particular, the heat pipe can flex axially and laterally (i.e., it can stretch as well as bend).

In one embodiment the heat pipe comprises a cable artery having a sliding connection to the condenser that provides freedom of movement between the condenser and the heat pipe (and the evaporator), in both the axial as well as lateral directions. A polytetrafluoroethylene (PTFE or Teflon®) sleeve can be provided over the cable artery to protect the bellows from abrasion due to contact with the cable artery.

The heat pipe preferably will allow relative motion between the evaporator and condenser in all directions. In one embodiment, for use in small-sized electronics applications, the heat pipe may allow relative motion between the evaporator and condenser of ±0.150 inches in all directions, which provides a maximum geometric cumulative motion of ±0.260 inches. To allow this relative motion, a sliding joint is provided between the end of the cable artery and inner diameter of the condenser tube. The end of the braided cable artery is splayed out and folded back upon itself. The splayed portion is sufficiently larger than the original diameter, and is inherently springy so that it ensures contact with the inner surface of the condenser. Thus, condensate from the heat pipe can be wicked into the cable artery for transport back to the evaporator.

A bellows may be used to provide flexibility in the heat pipe envelope. Due to the small size of the overall envelope associated with modern electronic devices, a very small bellows may be required. Such a bellows may have a very thin wall, which in one embodiment may be less than 0.001-inch thick. To protect the bellows from abrasion damage from the cable artery during flexing, a PTFE sleeve may be used. The sleeve may be slid over the cable artery and fixed between cable and bellows. The sleeve may be perforated to allow vapor to escape, so that the cable artery wick can prime.

A flexible heat pipe system is disclosed, comprising a condenser having an inner surface, an evaporator, a bellows having a condenser engaging end and an evaporator engaging end, and a flexible braid element disposed within the bellows portion. The braid element may have a condenser engaging end and an evaporator engaging end, the condenser engaging end being sized to engage the inner surface of the condenser to allow the condenser and the evaporator to move with respect to each other. The flexible braid element may be capable of transporting condensed working fluid from the condenser to the evaporator by capillary action.

A heat removal system is further disclosed, comprising a flexible braided member having first and second ends, a condenser having an inner surface engaged with the first end of the braided member, and an evaporator engaged with the second end of the braided member. A bellows member may be provided having a first end connected to the condenser and a second end connected to the evaporator, the bellows further may encompass the flexible braided member. The first end of the flexible braided member may be turned inside out and folded back over onto itself to provide an increased diameter portion, the increased diameter portion having an outer dimension that is at least equal to an inner dimension of the inner surface of the condenser. The flexible braided member further may be capable of transporting condensed working fluid from the condenser to the evaporator by capillary action.

A flexible heat pipe assembly is additionally disclosed, comprising a metal cable artery having first and second ends, the first end being turned inside out and folded back over onto itself to form an increased-diameter portion. A condenser may be provided having an inner surface dimensioned to engage the increased-diameter portion of the cable artery. An evaporator may be connected to the second end of the tubular member; and a bellows member may surround the cable artery. The bellows may have a first end connected to the condenser and a second end connected to the evaporator. Thusly arranged, the engagement between the tubular member and the condenser may allow relative axial movement between the artery and condenser pieces during operation. Additionally, the cable artery may be laterally flexible to allow the condenser and evaporator to move laterally with respect to each other during operation. Further, the cable artery may be capable of transporting condensed working fluid from the condenser to the evaporator by capillary action.

It is to be understood that the present invention is by no means limited only to the particular constructions herein disclosed and shown in the drawings, but also comprises any modifications or equivalents within the scope of the claims.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION

Figure 1:
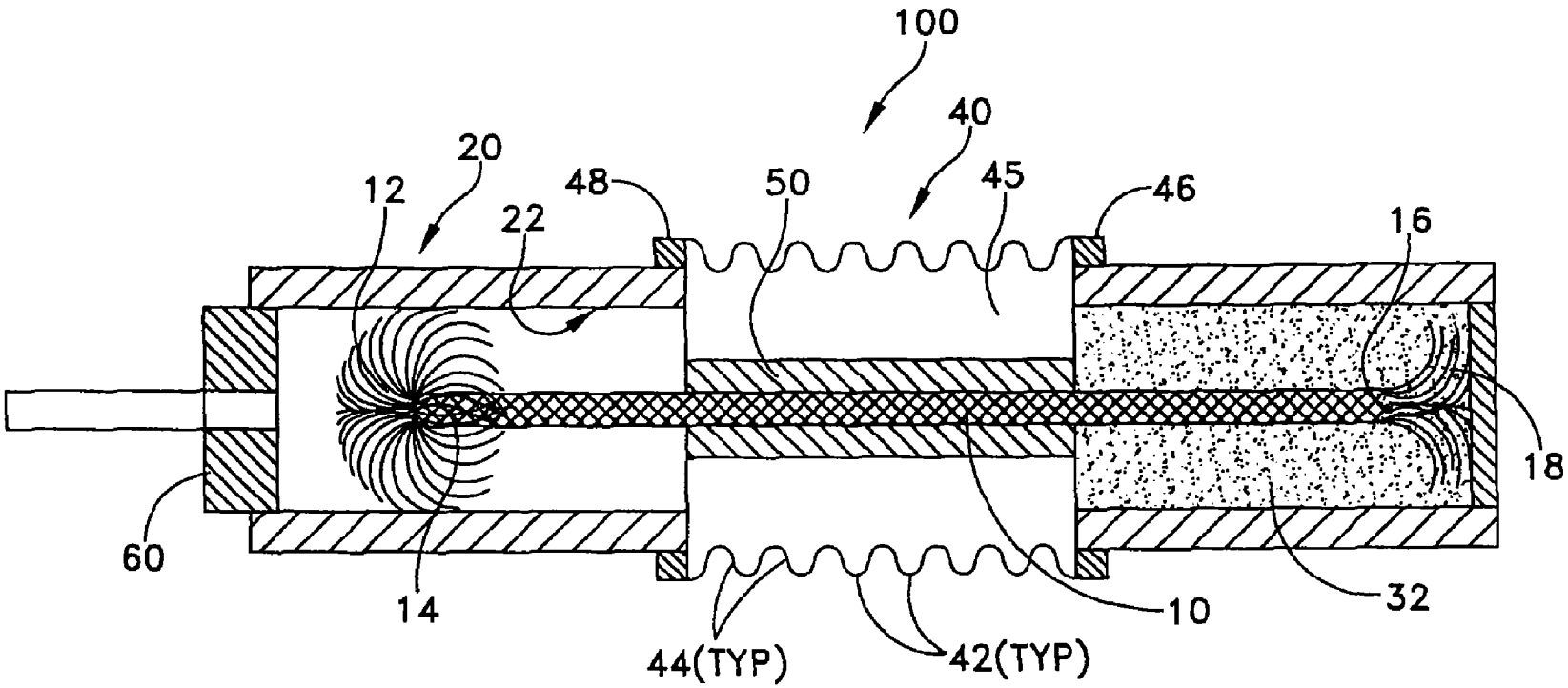
FIG. 1 is a cross-sectional view of the heat pipe system of the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Referring to FIG. 1, heat pipe assembly 100 is disposed between a condenser 20 and an evaporator 30, and comprises a bellows portion 40, a cable artery portion 10 and a protective sleeve portion 50. The cable artery portion 10 can be a braided metal element having a plurality of strands suitable for wicking liquid working fluid from the condenser 20 to the evaporator 30 via capillary action. The bellows portion 40 can be fixed to the condenser 20 and evaporator 30 and forms a vapor tight connection with each. The cable artery 10 is disposed coaxially within the bellows portion 40, creating a space therebetween. One end of the artery 10 is embedded within a wick element 32 disposed within the evaporator 30. The opposite end of the artery 10 is disposed within the condenser 20 in a manner that allows the artery 10 to move with respect to the condenser 20. Each end of the cable artery 10 is splayed to maximize the influx of condensed working fluid from the condenser 20 and efflux to the evaporator 30.

During operation, heat from a heat source (not shown) is applied to the evaporator. Working fluid in vapor form is thus generated in the evaporator 30 and is transported to the condenser 20 via the space 45 between the bellows member and the cable artery 10. The fluid is condensed in the condenser 20 and is then wicked back to the evaporator 30 via capillary action in the cable artery 10.

In one embodiment, the cable artery 10 comprises a braided metal element formed over a mandrel, and it is this braid structure that provides the desired capillary action for directing condensed working fluid from the condenser 20 to the evaporator 30. As a result of the mandrel forming process (and once the mandrel is removed) the cable artery 10 may have a longitudinal central opening 11 (FIG. 2), which can act as a conduit through which vaporized working fluid can be directed from the evaporator 30. In one exemplary embodiment, the opening 11 can be about 0.040-inches in diameter.

Figure 3A:
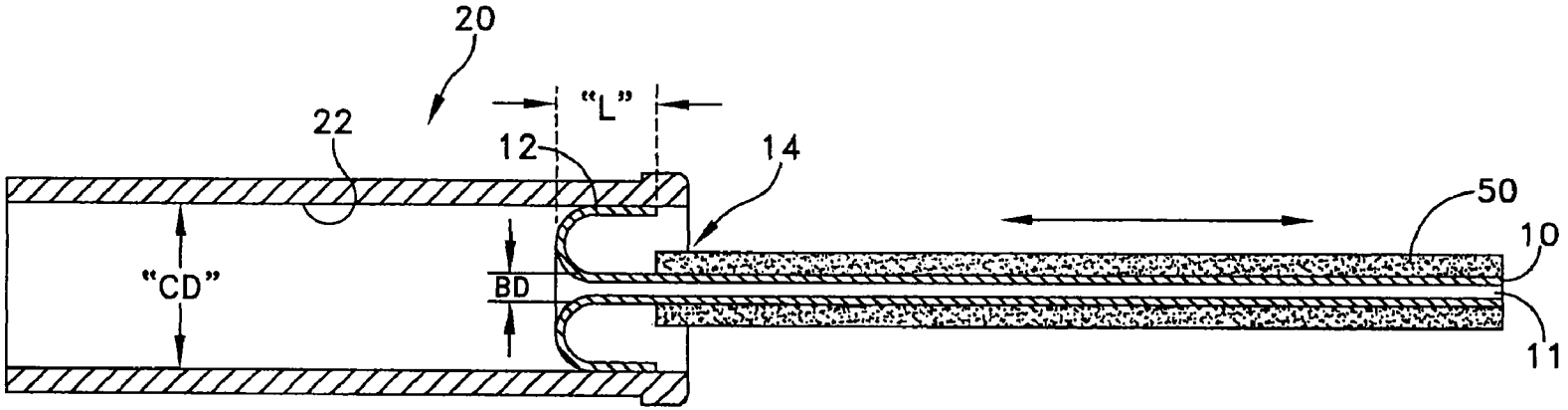
FIGS. 3*a* and 3*b* are cross-sectional views of a first embodiment of a connection between the condenser and braided wick of FIG. 2 taken along line 2-2 of FIG. 1.

Referring to FIGS. 1 and 3*a*, the condenser 20 may comprise a solid cylindrical member having an inside diameter "CD" substantially larger than the outer diameter "BD" of the cable artery 10. A first end 14 of the cable artery 10 is disposed within the condenser 20 and has a tip portion 12 that is turned inside out and folded back onto itself (i.e. it is "splayed") inside the condenser 20. Splaying increases the diameter of the cable artery 10, thus ensuring positive contact between the cable artery 10 and the inner surface 22 of the condenser 20. This positive contact facilitates efficient transfer of the liquid working fluid from the condenser to the cable artery 10 so that the liquid collected in the condenser 20 can be wicked back to the evaporator 30.

It is also noted that the described splay arrangement, in which the tip portion 12 is turned inside out and folded back onto itself, it expected to provide excellent long term engagement between the tip 12 and the condenser 20. This is contrasted with an arrangement in which the tip of the cable artery is merely expanded to contact the inner surface 22 of the condenser. Such an "expanded" arrangement may be expected to relax over time, and may compromise engagement between the artery tip and the condenser.

Like the first end 14, the second end 16 of the cable artery can have a splayed portion 18 for enhancing transfer of fluid from the cable artery 10 to the evaporator 30. Unlike the first end, however, the second end 16 can be fixed both laterally and axially to the evaporator 30. In the embodiment of FIG. 1, the second end 16 of the cable artery 10 is embedded within a wick element 32 disposed within the evaporator 30. Additionally, the second end 16 needn't be turned inside out and folded back on itself in order to provide the desired long term contact with the evaporator 30. Rather, the second end 16 can be merely expanded, since it will be fixed to the evaporator 30 and thus is not expected to relax over time.

Providing a fixed connection between the artery and evaporator can be advantageous because the majority of the thermal resistance of the system is expected to occur at the evaporator, and thus optimal thermal contact is desired at this location. In one embodiment, the artery/evaporator connection is achieved by sintering the second end 16 of the artery into a powder wick matrix (wick element 32) in the evaporator 30.

Referring again to FIG. 1, an exemplary bellows member 40 is illustrated. The bellows 40 provides a sealed flexible envelope between the evaporator 30 and condenser 20. Thus, it acts in concert with the cable artery 10 (which acts as a wick element of varying length, as will be described in greater detail below) to accommodate the varying length between the evaporator 30 and condenser 20. The bellows member 40 can be a corrugated cylindrical member having a series of folds 42 with surfaces 44 oriented substantially perpendicular to the longitudinal axis of the bellows member to provide axial and lateral flexibility between the condenser 20 and evaporator 30. Respective ends 46, 48 of the bellows member 40 can be attached to the evaporator 30 and condenser 20 by brazing or other appropriate connection method to provide a vapor tight connection between the three pieces. The bellows member 40 should have sufficient thickness to withstand the fluid pressures generated during operation of the device, but should also be thin enough to allow the desired degree of flexibility between the evaporator and condenser. In one embodiment, the bellows is made of nickel material having a diameter of approximately 0.167-inches and a thickness of about 0.001-inch. Where larger diameter bellows are appropriate, bronze may be used in (e.g., approximately 0.31 inches in diameter and 0.005 inches thick).

It is noted that providing a corrugated cylindrical bellows member 40 is not critical, and other types and shapes of sealed flexible closures could also be used. In one exemplary embodiment, an appropriately-sized stainless steel tube, coiled like a spring, could be used to provide the desired flexible, vapor-tight, connection between the condenser and evaporator.

As previously noted, a protective sleeve 50 can be provided over at least a portion of the length of the cable artery 10 in order to protect the bellows member 40 from damage due to contact with the artery. Thus, the protective sleeve 50 need only be disposed over the portion of the cable artery that resides within the bellows 40, as is illustrated in FIG. 1. It is expected however, that the protective sleeve 50 will extend slightly into the condenser 20 to provide a factor of safety and also to allow for some axial movement of the artery 10 with respect to the condenser. It is noted that the sleeve 50 is not intended to be a fluid boundary, and, although not shown, the sleeve may be variously perforated to facilitate priming of the cable artery 10 during operation.

Since the sleeve 50 is merely an abrasion protector, its dimensional tolerances are not critical, and a size may be chosen that allows the sleeve to be easily slipped on over the cable artery 10. In one exemplary embodiment, the protective sleeve 50 comprises polytetrafluorethylene (PTFE, a well known example of which is Teflon®), although other appropriate flexible protective materials could also be used.

Figure 2:
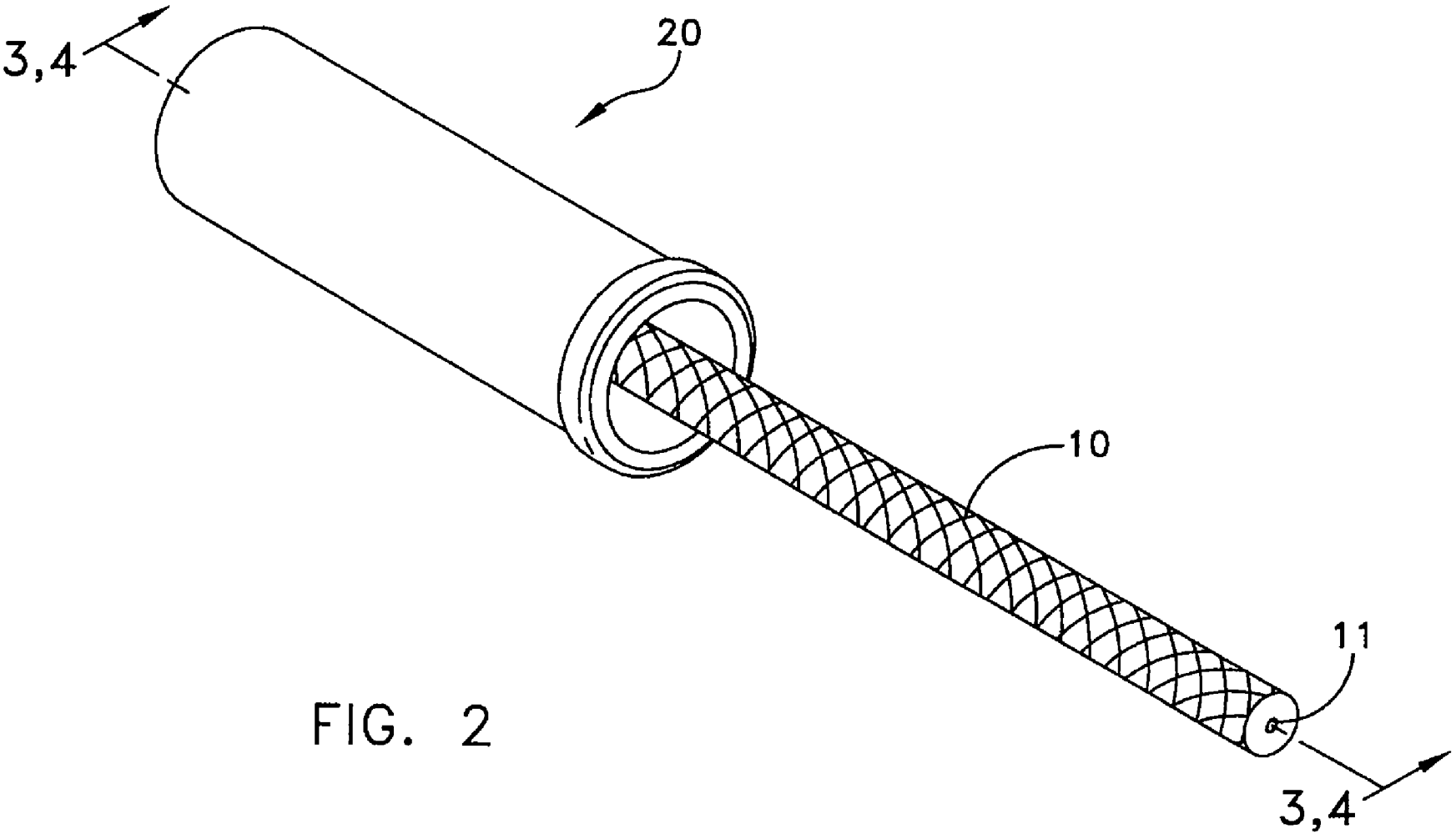
FIG. 2 is a perspective view of an exemplary connection between condenser and braided wick portions of the system of FIG. 1.

As will be apparent, FIG. 2 shows the relationship between the cable artery 10 and condenser 20, without the bellows 40, evaporator 30 or protective sleeve 50 elements. Likewise, FIGS. 3*a*-4*b* show the interconnection between the cable artery (with protective sleeve) and the condenser 20, again without reference to the bellows or evaporator elements.

Figure 3B:
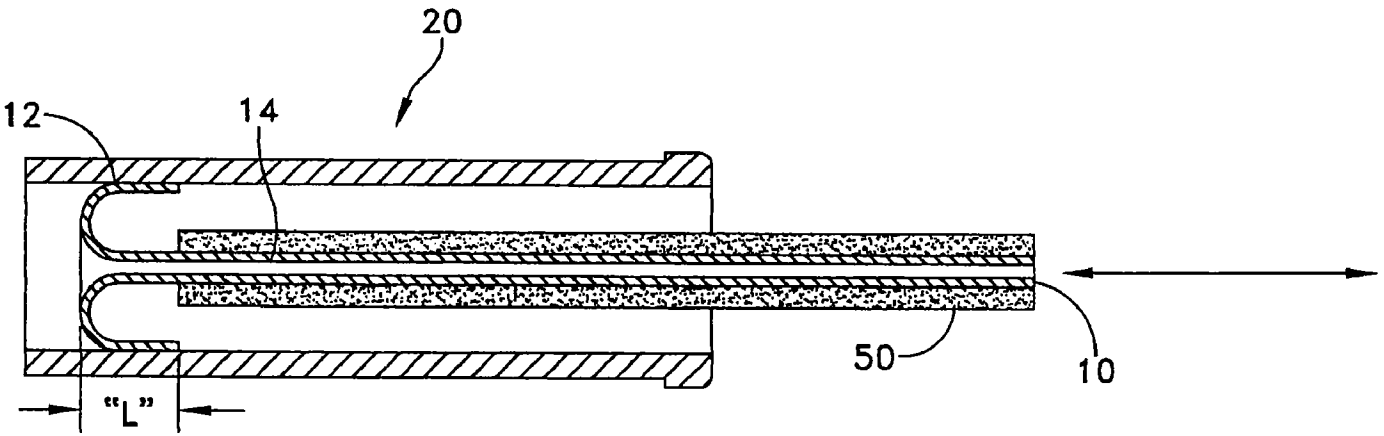

Referring to FIGS. 3*a* and 3*b*, a portion of the first end 14 of cable artery 10 is turned inside out and folded back onto itself to form splayed tip 12. The splayed tip 12 is sufficiently expanded that it engages the inner surface 22 of the condenser 20. Thusly arranged, the cable artery 10 can move axially in and out of the condenser in the manner indicated by the arrows. That is, the splayed end 12 can slide along the inner surface 22 of the condenser 20 as required to accommodate changes in the distance between the condenser and evaporator, while still maintaining sufficient contact with the condenser to enable efficient transfer of condensed fluid to the cable artery 10. Thus, the length "L" of the splayed tip 12 remains substantially constant throughout operation.

Figure 4A:
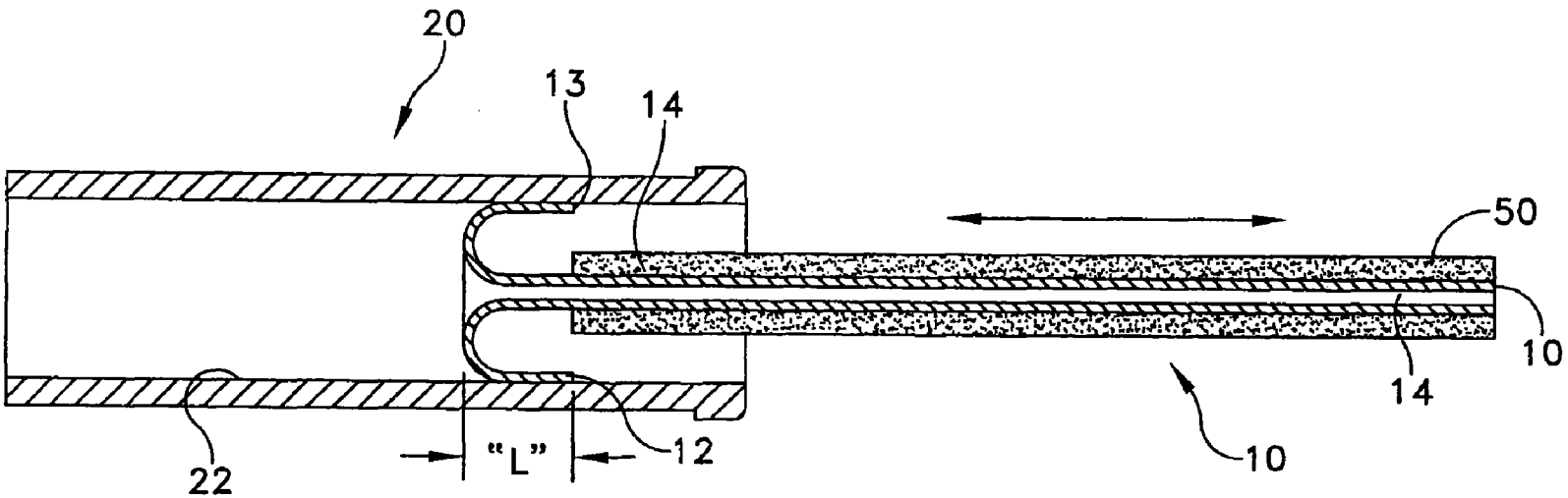
FIGS. 4*a* and 4*b* are cross-sectional views of a second embodiment of a connection between the condenser and braided wick of FIG. 2.
Figure 4B:
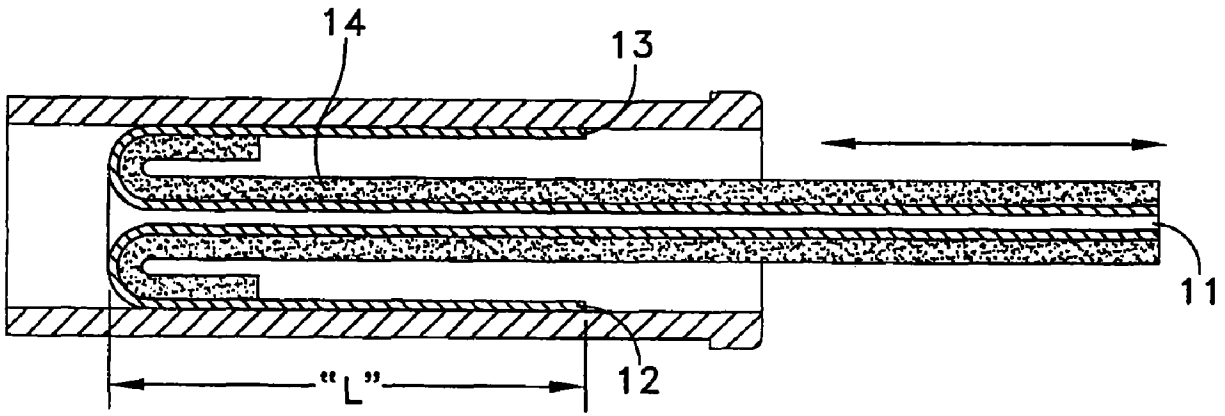

Referring to FIGS. 4*a* and 4*b*, an alternative of the flexible connection between the cable artery 10 and condenser 20 is illustrated. The cable artery 10 of this embodiment is splayed in a manner similar to that of the embodiment of FIGS. 2*a, b* (i.e. turned inside out and folded back over on itself). Instead of sliding over the inner surface 22 of the condenser 20, however, the distal end 13 of the artery 10 is fixed to the condenser 20. Fixing the surfaces together ensures that the braid 12 will not pull apart from the condenser 20 during operation, and although the distal end 13 of the artery is fixed to the condenser 20, substantial relative axial movement of the two will be provided by the inherent flexibility of the braid 12 and sheath 16.

Thus, the artery 10 has the ability to turn inside out (i.e. splay) by a greater or lesser amount, depending on the amount of movement of the artery 10 within the condenser 20. This is best shown by reference to FIGS. 4*a, b*. In FIG. 4*a*, the artery 10 is shown at or near its maximum axial extension away from the condenser 20, with only a small portion "L" of the first end 14 turned inside out, or "splayed." FIG. 4*b* shows the artery 10 at or near its minimum extension from the condenser 20, with a relatively larger portion "L" of the first end 14 turned inside out. The ultimate degree of splaying (i.e. the magnitude of length L) in this embodiment will automatically adjust to accommodate the configuration of the system during operation. This "variable splaying" embodiment can operate to isolate vibrations from the condenser 20 from the remainder of the system in the same manner as with the embodiment of FIGS. 3*a, b*.

The cable artery 10 in all cases is configured to accommodate rapid and/or cyclical changes in length L corresponding to anticipated vibrational motion of the condenser 20 at any of a variety of frequencies. It is noted that the heat pipe 10 of FIGS. 4*a, b* will also accommodate lateral movement with respect to the condenser 20 similar to that described in relation to the embodiment of FIGS. 3*a, b*.

Preferred materials of construction for all elements of the device are nickel and nickel alloys, although other materials, such as bronze, can also be used as desired (i.e., for larger-sized heat pipes) without detracting from the principles of the invention.

It is noted that although the invention has been described in relation to a heat pipe arrangement having a single connection between the condenser and evaporator, the principles of the invention could be also be applied to a loop heat pipe. Additionally, the dimensions provided are merely exemplary, and it is expected that the principles of the invention can be applied to a wide range of sizes of heat pipes and their associated components.

Accordingly, it should be understood that the embodiments disclosed herein are merely illustrative of the principles of the invention. Various other modifications may be made by those skilled in the art which will embody the principles of the invention and fall within the spirit and the scope thereof.

What is claimed is:

1. A flexible heat pipe, comprising;

a condenser having an inner surface;

an evaporator having an inner surface;

a bellows portion having a first end connected to the condenser and a second end connected to the evaporator; and a continuous wick element comprising a plurality of strands disposed within the heat pipe and having a condenser engaging end and an evaporator engaging end and a central portion therebetween, wherein strands from at least one of the condenser engaging end and the evaporator engaging end are splayed such that the at least one of the condenser engaging end and the evaporator engaging end is engaged with the inner surface of the condenser or the inner surface of the evaporator, respectively.

2. The flexible heat pipe of claim 1, wherein the continuous wick element has a central axis extending between the condenser engaging end and the evaporator engaging end and wherein a portion of the condenser engaging end of the continuous wick element extends away from the central axis when the condenser engaging end is engaged with the inner surface of the condenser to provide an increased cross-sectional length portion that is equal to or greater than a corresponding dimension of the inner surface of the condenser to provide positive engagement between the continuous wick element and the condenser.

3. The flexible heat pipe of claim 1, wherein the continuous wick element comprises a cable artery having a central opening, the cable artery being laterally flexible to allow relative movement between the condenser and the evaporator during operation without compromising the engagement between the artery and the inner surface of the condenser.

4. The flexible heat pipe of claim 1, further comprising a protective sleeve surrounding at least a part of the central portion of the continuous wick element to prevent damage to the bellows due to contact with the continuous wick element, the protective sleeve further comprising a plurality of holes to allow priming of the continuous wick element.

5. The flexible heat pipe of claim 4, wherein the protective sleeve comprises polytetrafluoroethylene (PTFE).

6. The flexible heat pipe of claim 1, the evaporator further comprising a wick structure, within which the evaporator engaging end of the continuous wick element is fixed.

7. The flexible heat pipe of claim 6, wherein the wick structure comprises a sintered wick, and the evaporator engaging end of the continuous wick element is embedded within the sintered wick.

8. The flexible heat pipe of claim 1, wherein the central portion has a smaller cross-sectional length than at least one of the condenser engaging end and the evaporator engaging end, and the condenser engaging end and the evaporator engaging end are coupled to the inner surface of the condenser and the inner surface of the evaporator, respectively, to allow at least one of the condenser and the evaporator to move relative to the other and to transport working fluid from the condenser to the evaporator by capillary action.

9. The flexible heat pipe of claim 1, wherein at least one of the condenser engaging end and the evaporator engaging end has a larger cross-sectional length than the central portion when the at least one of the condenser engaging end and the evaporator engaging end is engaged with the inner surface of the condenser or the inner surface of the evaporator, respectively.

10. A heat removal system, comprising:

a continuous wick member comprising a plurality of strands, the wick member having first and second ends joined by a central portion;

a condenser having an inner surface coupled with the first end of the continuous wick member;

an evaporator coupled with the second end of the continuous wick member; and a bellows member having a first end connected to the condenser and a second end connected to the evaporator;

wherein, strands from the first end of the continuous wick member are splayed and are coupled with the inner surface of the condenser; and wherein the continuous wick member is capable of transporting condensed working fluid from the condenser to the evaporator by capillary action and wherein the continuous wick member is coupled between the condenser and the evaporator to allow the condenser and the evaporator to move relative to one another.

11. The heat removal system of claim 10, wherein the bellows member is fixedly engaged with the condenser and evaporator to create a vapor tight fluid envelope.

12. The heat removal system of claim 10, wherein the continuous wick member comprises a cable artery, the cable artery being laterally flexible to allow relative movement between the condenser and the evaporator during operation without compromising the engagement between the artery and the inner surface of the condenser.

13. The heat removal system of claim 10, further comprising a protective sleeve surrounding at least a part of the central portion of the continuous wick member to prevent damage to the bellows due to contact with the continuous wick member, the protective sleeve further comprising a plurality of holes to allow priming of the continuous wick member.

14. The heat removal system of claim 10, the evaporator further comprising a sintered wick structure, within which the second end of the continuous wick member is embedded.

15. The heat removal system of claim 10, wherein the increased cross-sectional length portion of the continuous wick member is slidably engaged with the inner surface of the condenser.

16. The heat removal system of claim 10, wherein the first end of the continuous wick member has a cross-sectional length that is larger than the central portion and that is at least equal to an inner dimension of the inner surface of the condenser.

* * * * *